US006907683B1

(12) United States Patent
Kronblad

(10) Patent No.: US 6,907,683 B1
(45) Date of Patent: Jun. 21, 2005

(54) BADGE, SUCH AS CAMPAIGN BUTTON

(75) Inventor: Björn Kronblad, Åseda (SE)

(73) Assignee: Quickbutton Badges AB, Trosa (SE)

( * ) Notice: Subject to any disclaimer, the term of this patent is extended or adjusted under 35 U.S.C. 154(b) by 0 days.

(21) Appl. No.: 10/129,934

(22) PCT Filed: Nov. 15, 1999

(86) PCT No.: PCT/SE99/02080

§ 371 (c)(1),
(2), (4) Date: Jun. 3, 2002

(87) PCT Pub. No.: WO01/35785

PCT Pub. Date: May 25, 2001

(51) Int. Cl.[7] ..... A44C 3/00
(52) U.S. Cl. ..... 40/1.5; 40/1.6; 40/661.04
(58) Field of Search ..... 40/1.5, 1.6, 661.11, 40/586, 661.04

(56) References Cited

U.S. PATENT DOCUMENTS 2,392,351 A 1/1946 Wolf
3,212,204 A 10/1965 Smith
3,755,522 A 8/1973 Jope et al.
4,130,956 A 12/1978 Eddy et al.
5,050,323 A * 9/1991 Gagnon ..... 40/1.5
6,041,533 A * 3/2000 Lemmond, Jr. ..... 40/584

FOREIGN PATENT DOCUMENTS

GB 2229083 A * 9/1990 ..... A47G 23/03
GB 2 242 669 10/1991

* cited by examiner

*Primary Examiner*—Cassandra Davis
(74) *Attorney, Agent, or Firm*—Burns, Doane, Swecker & Mathis, LLP

(57) ABSTRACT

A badge, such as a campaign button, has a front side which serves as an outwardly visible display surface, and a rear side which serves as an attachment surface of a holder means, such as a safety pin, an adhesive tape or a magnet. The front side is made of a transparent first plastic sheet and the rear side is made of a second plastic sheet. A picture which is visible through the transparent first plastic sheet, is positioned between the plastic sheets, which are joined together by means of a special laminating and forming method and a special punch and formed so that the peripheral area of the front side is bent back towards the rear side.

4 Claims, 1 Drawing Sheet

BADGE, SUCH AS CAMPAIGN BUTTON

TECHNICAL FIELD

The present invention relates to a badge, such as a campaign button or a label, comprising a front side, which serves as an outwardly visible display surface, and a rear side, which serves as an attachment surface of a holder means, such as a safety pin or a magnet. In addition, the invention relates to a method and a device for manufacturing such a badge.

BACKGROUND OF THE INVENTION

Devices of the inventive type are generally known in professional circles as badges and are considered to comprise everything from said campaign buttons, which are mass produced for temporary use, to product tags, which are used by companies to mark products with the company's logotype, and name badges, which are manufactured individually and intended to be used repeatedly for a longer period of time. They all have in common that they should have an appealing and generally also exclusive design, but their manufacturing cost must also be kept down due to severe competition on the market.

Traditionally, badges are manufactured in the form of round campaign buttons which are made of a plastic rear piece, around which a thin piece of sheet metal is bent, which when being bent clamps, between itself and the rear piece, a piece of paper placed under a protective plastic sheet on the metal sheet. The piece of paper contains the campaign message in the form of a picture, which is visible through the plastic sheet and can consist of a text and/or some form of image, such as a photograph. One of the advantages of such round campaign buttons is that the parts included are relatively cheap and that the buttons, owing to the bending around the rear piece, get some degree of depth, which in combination with the shining surface provided by the plastic sheet results in the desired appealing and exclusive design. One of the drawbacks is that the manufacturing method is only usable for round or possibly oval badges and that the badge itself consists of a blend of different materials, such as plastic and tinplate, which causes problems when sorting out the waste as eventually the badge is to be thrown away.

Many of today's product badges are manufactured in such a manner that a picture, such as a company logotype, which can be screen printed on a carrier or engraved in a piece of plastic or sheet metal, is provided with a coating of epoxy resin. Admittedly, this method results in a very appealing badge that gives an impression of high quality, but the badge is also very expensive and difficult to manufacture from the point of view of work environment.

Today, name badges are in most cases manufactured of a relatively thick piece of plastic, which is machined by means of a milling cutter to engrave the desired name and possibly to form the outline. It should be understood that such a name badge does not create much problems when sorting out the waste, but the costs of such a name badge are quite high as a comparatively great amount of plastic material is needed and the manufacturing method is very time-consuming. Moreover, it should be understood that the possibilities of varying such name badges are fairly limited.

OBJECTS OF THE INVENTION

In view of that stated above, one object of the present invention is to provide a badge which is of the type mentioned by way of introduction and which gives the same impression of depth and has the same lustre as today's round campaign buttons in spite of a lower manufacturing cost. Another object is that the outline of the badge should not be limited to a round or oval shape. A further object is that the badge should not cause any difficulties when sorting out the waste or from the point of view of work environment. Moreover, thanks to the optional outline and the rational manufacturing method, the badge according to the invention should advantageously be usable as a name badge. Finally, it is an additional object of the invention to provide a badge having a considerably lower weight than prior-art solutions, thus being easier to attach and carry.

SUMMARY OF THE INVENTION

According to the invention, these objects are achieved by means of a badge of the type stated by way of introduction, said badge being characterised in that the front side is made of a transparent first plastic sheet, that the rear side is made of a second plastic sheet, and that a picture, which is visible through the transparent first plastic sheet, is positioned between the plastic sheets, which are joined together and formed so that the peripheral area of the front side is bent back towards the rear side.

Since the badge according to the invention only consists of two joint plastic sheets and a picture positioned between them, a product is provided which is considerably cheaper than prior-art solutions. Since at least one of the two plastic sheets is transparent and the picture is viewed through the same the picture also gets the same lustre as the round campaign button described by way of introduction, and since the periphery of the badge is bent backwards the same impression of depth is obtained as in this button. As there are no combinations of metal and plastic but only a plastic laminate with an intermediate picture, the badge according to the invention is easier than prior-art badges to sort out when it is to be thrown away. Finally, the optional outline and the very low weight make the inventive badge usable in considerably more situations than any other prior-art badge.

Preferably, the inventive plastic sheets each have a first side, which is made of high-melting plastic, and a second side, which is made of low-melting plastic, the second sides being joined together by heating the plastic sheets to the melting point of said second sides. In this connection, high-melting and low-melting, respectively, imply that the plastic materials have different melting points, so that when the low-melting plastic is getting sufficiently sticky for lamination the high-melting plastic is still dry but sufficiently elastically ductile for bending of the periphery of the badge.

According to a preferred embodiment, the inventive badge is formed so that the picture is applied to the front side of a piece of printed material, which is located between the plastic sheets. The great advantage of this solution is that the picture can be applied to a piece of printed material, such as a sheet of paper, by means of an ordinary colour printer, which offers many kinds of variations. When also the second plastic sheet is transparent from behind, it is also possible to see a picture which is applied to the rear side of the piece of printed material and which, for instance, shows a lottery number or a company's telephone number or address.

It will be understood that in some cases it may be suitable to apply the picture directly to one of the plastic sheets.

The invention also relates to a method for manufacturing a badge. This method comprises the steps of positioning a picture between two plastic sheets, of which at least one is transparent, laminating, under the action of heat and pressure, the two plastic sheets with the picture between them to form a homogeneous blank, and punching out at least one badge of the hot blank by means of a punch having a first tool, which comprises knives positioned in gaps between elastic pad elements, and a second tool, which comprises elastic pad elements and gaps located between said elastic pad elements and opposite to the knives in the first tool, said knives in cooperation with the gaps and the elastic pad elements punching out the badge and bending the peripheral area of the badge in the direction away from the first tool towards the second tool.

The advantage of the method according to the invention is that it allows a very rational and flexible manufacturing process, which is best used if many badges are at the same time punched out and formed of a laminated sheet, for instance in A4-format. Before laminating, the picture is suitably applied to a piece of printed material, which is subsequently arranged between the plastic sheets. It goes without saying that it is also possible to apply the picture directly to one of the plastic sheets before laminating.

Finally, the invention also relates to a device for manufacturing a plate-shaped badge. This device is characterised in that it comprises a hot press for laminating two plastic sheets which are arranged on top of each other and between which a picture is positioned, and a punch for punching out and forming at least one plate-shaped badge of the hot, laminated plastic sheets, the punch having a first tool, which comprises knives positioned in gaps between elastic pad elements, and a second tool, which comprises elastic pad elements and gaps located between said elastic pad elements and opposite to the knives in the first tool, said pad elements in the first and the second tool being adapted to clamp the hot, laminated plastic sheets between them, and said knives in cooperation with the gaps and the elastic pad elements being adapted to punch out the badge and bend the peripheral area of the badge in the direction away from the first tool towards the second tool.

It will be understood that in such a device it is the knives that define the outline of the badge and, in cooperation with the pad elements and the gaps especially in the second tool, provide the bending of the periphery of the badge. It will, however, also be understood that the punched laminate must be warm and ductile and, during punching, be held in place and kept together by the elastic pad elements. Preferably, the pad elements in the second tool have central elevated plateaux to obtain sharper bending of at least the peripheral area of the badge.

BRIEF DESCRIPTION OF THE DRAWING

The invention will now be described in more detail with reference to the accompanying schematic drawing, in which arrows without reference numerals indicate directions of motion and in which.

DESCRIPTION OF AN EMBODIMENT

Figure 5:
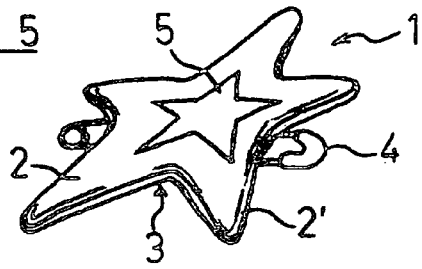
FIG. 5 shows a badge according to the invention.

The inventive badge 1, which is shown in FIG. 5, has the form of a star-shaped campaign button. It has a front side 2, which serves as an outwardly visible display surface, and a rear side 3, which serves as an attachment surface of a holder means 4, in this embodiment a safety pin. The front and the rear sides 2, 3 are made of transparent plastic sheets, which are joined together in a manner described below in more detail and which are formed so that the peripheral area 2' of the front side 2 is bent back towards the rear side 3. A picture 5, in this case in the form of a star, is visible through the transparent front side 2 and has a very appealing lustre thanks to the transparency of the front side.

When manufacturing the badge 1 according to FIG. 5, use is preferably made of the following method and device illustrated in FIGS. 1–4. According to FIG. 1, sheets of paper 6 provided with a picture, for instance, in the form of a photograph or a text are first moved from a stack 7 and inserted between two transparent plastic sheets 8, 9. These plastic sheets are supplied as entire webs by two rolls 10, 11 and fed between two hot rolls 12, 13. The heat and the pressure exerted by the hot rolls cause the two plastic sheets 8, 9 with the inserted sheet of paper 6 to laminate into a homogeneous web 14. This web is subsequently divided up by means of knives 15, 16 into separate laminated sheets 17, which are placed on a stack 18.

Subsequently, separate laminated sheets 17 are fed from the stack 18 into a hot press 19, in which the sheets 17 are heated so as to get soft and ductile. The warm sheets 17 are then fed individually into a punch 20, in which a plurality of badges 1 are punched out and formed of each sheet 17 in a manner that will be described in more detail below.

Figure 1:
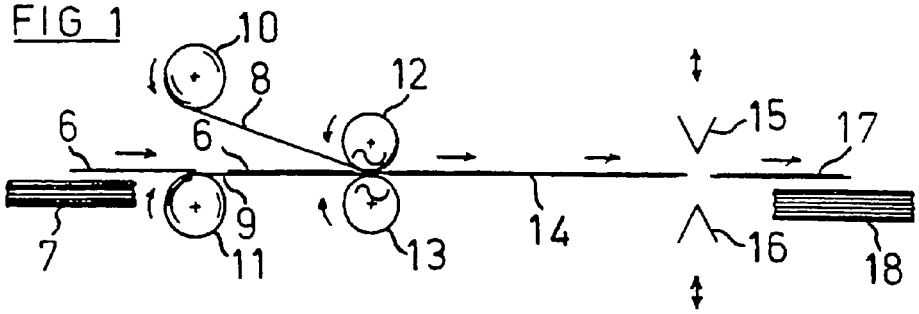
FIG. 1 illustrates a first manufacturing step.
Figure 2:
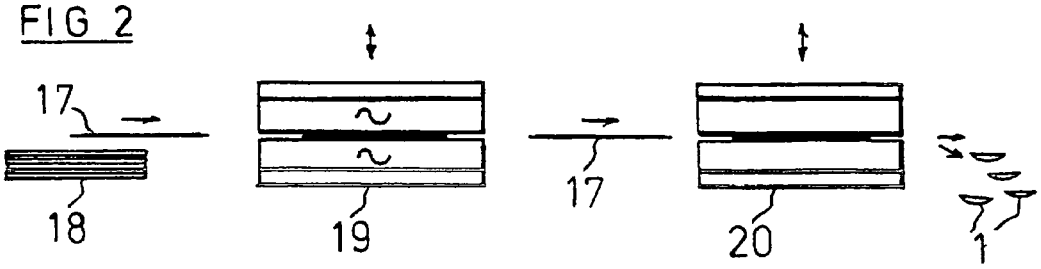
FIG. 2 illustrates a second manufacturing step.
Figure 3:
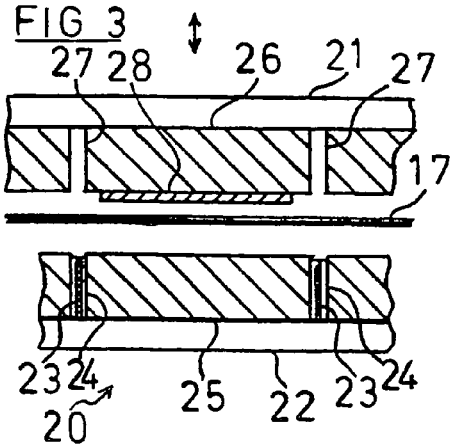
FIGS. 3 and 4 illustrate stages during the second manufacturing step in the form of sectional views.
Figure 4:
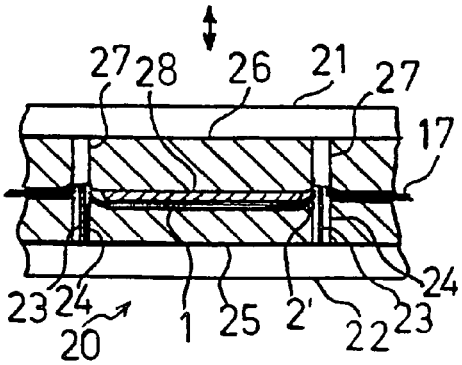

FIGS. 3 and 4 show a part of the punch 20 in cross-section in two different positions of operation. As shown in the position of operation in FIG. 3, in which the punch is shown in an open condition, the punch 20 has a movable upper tool 21 and a fixed lower tool 22. The lower tool 22 has knives 23, which are directed upwards and which are positioned in narrow gaps 24 between elastic pad elements 25 with approximately the same height as the knives 23. Also the upper tool comprises elastic pad elements 26 and has gaps 27 which are located between said pad elements and opposite to the knives 23 in the lower tool 22. As appears from the position of operation in FIG. 4, in which the punch 20 is shown in a closed condition, the pad elements 25, 26 in the lower and the upper tools 21, 22 are adapted to clamp between them the hot laminated sheets 17 and the knives 23, in cooperation with the gaps 27, are adapted to punch out the badge 1 and bend the peripheral area 2' of the badge 1 in the direction away from the lower tool 22 towards the upper tool 21. The badge 1 keeps the shape which is provided by the punch 20 also after the opening of the punch 20, the elastic pad elements 26 in the upper tool acting as ejectors of the badge.

The person skilled in the art will realise that the badge 1 according to the invention is suitably made of thermoplastic and that the properties of the selected plastic material decide the suitable laminating and forming temperature. The person skilled in the art will also understand that the picture 5 does not have to be printed on a sheet of paper 6, as described above, but can also be provided, for instance, on a sheeting or be printed directly on one or even on both of the plastic sheets 8, 9. Moreover, the person skilled in the art will understand that the punching can also be performed directly after the lamination of the plastic sheets 8, 9. In addition, the person skilled in the art will understand that it is easy, for instance by forming central elevated plateaux 28 on the pad elements 26 of the upper tool 21, to provide sharper bending at least of the peripheral area 2' of the badge 1 or to obtain completely convex badges 1. Finally, the person skilled in the art will understand that, besides said safety pin or magnet, the holder means 4 can also be, for instance, an adhesive tape, a clip, a drop of glue, etc.

What is claimed is:

1. A badge, comprising a front side, which serves as an outwardly visible display surface, and a rear side, which serves as an attachment surface of a holder means, the front side being made of a transparent first plastic sheet, that the rear side being made of a second plastic sheet, and a picture, which is visible through the transparent first plastic sheet, being positioned between the plastic sheets, the plastic sheets being joined together and formed so that a peripheral area of the front side is bent back towards the rear side, wherein the plastic sheets each have a first side, which is made of high-melting plastic, and a second side, which is made of low-melting plastic, the second sides being joined together by heating the plastic sheets to the melting point of the second sides.

2. A badge as claimed in claim 1, wherein the picture is applied to a front side of a piece of printed material, the piece of printed material being located between the plastic sheets.

3. A badge as claimed in claim 2, wherein the second plastic sheet is transparent and the piece of printed material has a picture on its rear side.

4. A badge, comprising a front side, which serves as an outwardly visible display surface, and a rear side, which serves as an attachment surface of a holder means, the front side being made of a transparent first plastic sheet, that the rear side being made of a second plastic sheet, and a picture, which is visible through the transparent first plastic sheet, being positioned between the plastic sheets, the plastic sheets being joined together and formed so that a peripheral area of the front side is bent back towards the rear side, wherein the picture is applied to the front side of a piece of printed material, which is located between the plastic sheets, and the second plastic sheet is transparent and the piece of printed material has a picture on its rear side.

* * * * *